United States Patent [19]

Falcone

[11] Patent Number: 4,640,174

[45] Date of Patent: Feb. 3, 1987

[54] SOUNDBOARD CALIBRATOR

[75] Inventor: Santi Falcone, Carlisle, Mass.

[73] Assignee: Falcone Piano Company, Haverhill, Mass.

[21] Appl. No.: 691,940

[22] Filed: Jan. 16, 1985

[51] Int. Cl.[4] ..... G10C 3/08
[52] U.S. Cl. ..... 84/196
[58] Field of Search ..... 84/192, 196, 184–188

[56] References Cited

U.S. PATENT DOCUMENTS 936,789 10/1909 Long ..... 84/196
1,033,601 7/1912 Long ..... 84/196

FOREIGN PATENT DOCUMENTS 87527 7/1896 Fed. Rep. of Germany ..... 84/196

*Primary Examiner*—Michael L. Gellner
*Assistant Examiner*—Brian W. Brown
*Attorney, Agent, or Firm*—Joseph S. Iandiorio; William E. Noonan

[57] ABSTRACT

A soundboard tension adjuster for a piano having a rim, a belly rail, a soundboard, plate, bridges and strings, the soundboard tension adjuster being interconnected between the rim and bell rail and including a beam member and adjustment means for varying the length of the adjuster to change the tension applied to the soundboard and modify its crown.

7 Claims, 6 Drawing Figures

SOUNDBOARD CALIBRATOR

FIELD OF INVENTION

This invention relates to a soundboard calibrator tension adjuster for varying the tension on and the crown of a piano soundboard.

BACKGROUND OF INVENTION

A piano soundboard is a sheet of spruce wood shaped to fit on the inner rim of the piano under the cast-iron plate and piano strings. The soundboard is not flat. It has a convex or inverted bowl shape known as the crown. It is this crown which gives a piano its unique sound. In crafting a piano the soundboard and the rim which supports it are carefully shaped and sized to produce the precise crown which renders the characteristic sound of that piano. Nevertheless, due to slight differences in size and shape, variations in mounting techniques, and wood qualities, all held to the highest possible standards, there will be a variation in the nature of the sound. Some pianos will have the characteristic sound while others, wholly within acceptable limits, will not. After manufacture during the life of the piano, temperature, humidity, shock and age will affect the tension and crowning of the soundboard and change the sound.

SUMMARY OF INVENTION

It is therefore an object of this invention to provide an improved piano in which the crown of the soundboard and thus the sound produced can be set to the optimum quality.

It is a further object of this invention to provide such an improved piano in which the optimum setting can be made at manufacture and afterwards during the life of the piano.

It is a further object of this invention to provide such an improved piano in which the tension on the soundboard can be adjusted.

It is a further object of this invention to provide such an improved piano in which the crowning of the soundboard can be varied to obtain optimum sound.

The invention results from the realization that the tension and crowning of a soundboard can be controlled to optimize the sound of the piano by using a tension adjuster between the rim and belly rail to adjust the tension on the soundboard and control the crowning.

This invention features a soundboard tension adjuster for a piano having a rim, a belly rail, a soundboard, plate, bridges and strings. The soundboard tension adjuster is interconnected between the rim and belly rail and includes a beam member and adjustment means for varying the length of the adjuster to change the tension applied to the soundboard and modify its crown.

In a preferred embodiment, the beam member is fixed with the belly rail and the adjustment means engages the rim. The adjustment means may be a bolt or small machine shop jack. There may be an intermediate beam disposed between the rim and belly rail transverse to the beam member and having guide means for receiving the beam member.

DISCLOSURE OF PREFERRED EMBODIMENT

Other objects, features and advantages will occur from the following description of a preferred embodiment and the accompanying drawings, in which.

The invention may be accomplished with a soundboard tension adjuster used in a grand piano or an upright having a rim, a belly rail, a soundboard, a cast iron plate, bridges and strings. The soundboard tension adjuster is interconnected between the rim and the belly rail and includes a beam member and an adjustment means for varying the length of the adjuster to change the tension applied to the soundboard and modify its crown. One end of the beam adjuster is fixed to move with the belly rail; the other is fixed to move with the rim. The adjustment means may be a bolt or jack mounted on a support beam which interconnects with the rim, and the other end of the bolt or jack engages a support beam which is attached to the belly rail. An intermediate support beam transverse to the beam member of the tension adjuster may be provided with a guide for receiving the beam member. By rotating the bolt or jack, the tension of the soundboard, and thus its crowning, may be controlled both at manufacture and afterwards, so that the optimum crown can be set and maintained for the piano.

Figure 1:
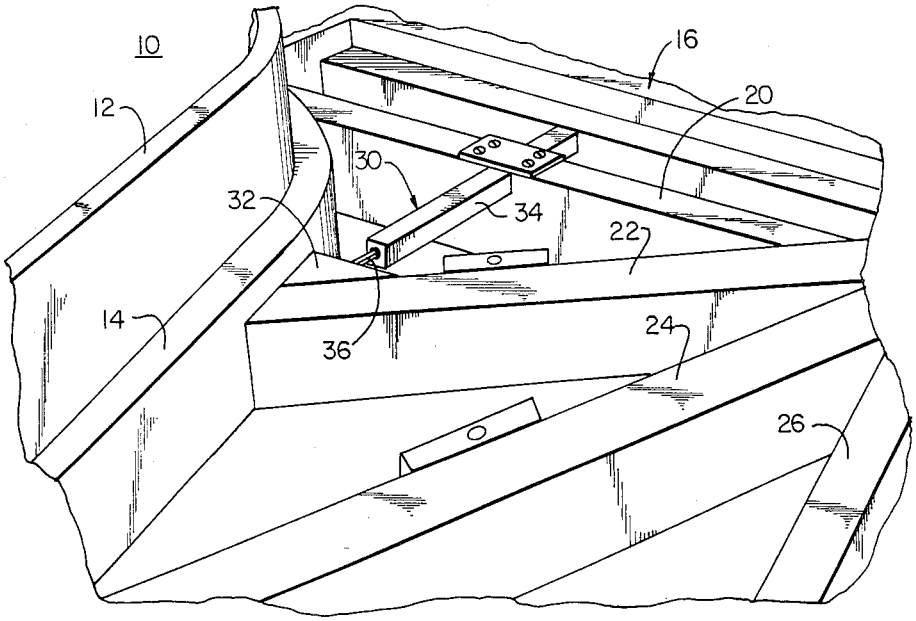
FIG. 1 is an axonometric view of a piano with a soundboard tension adjuster according to this invention with the soundboard, cast iron plate, strings and bridges removed.
Figure 2:
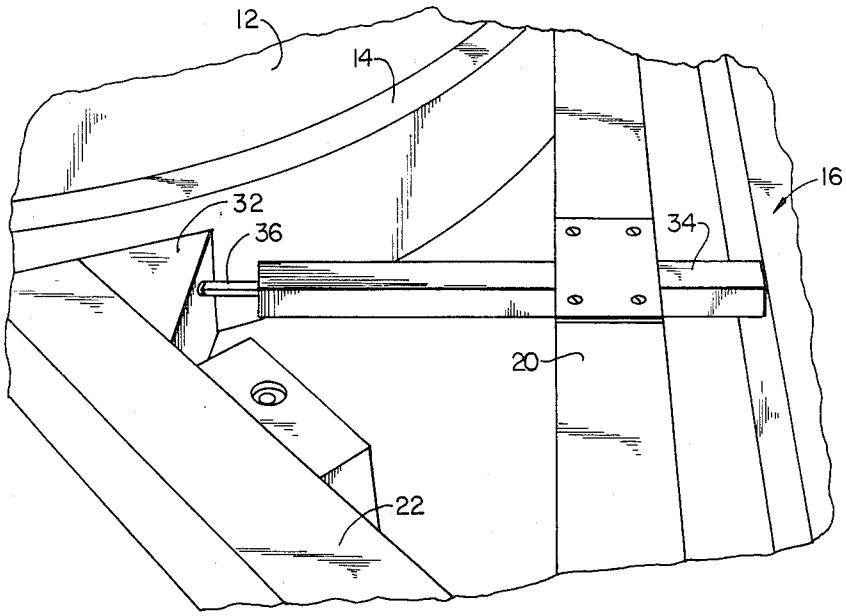
FIG. 2 is an enlarged view of a portion of FIG. 1 including the soundboard tension adjuster.

There is shown in FIG. 1 a piano 10 having an outer rim 12, inner rim 14, belly rail 16 and a plurality of spruce structural beams 20, 22, 24 and 26. Soundboard tension adjuster 30 is fixed at one end to belly rail 16, and at the other end to a fillet 32 which is mounted to beam 22 and rim 14. Tension adjuster 30 includes a beam 34, FIG. 2, and an adjustment means such as bolt 36. Beam member 34 attaches at one end to belly rail 16 and at the other end engages with bolt 36, which in turn is threaded into fillet 32.

Figure 3A:
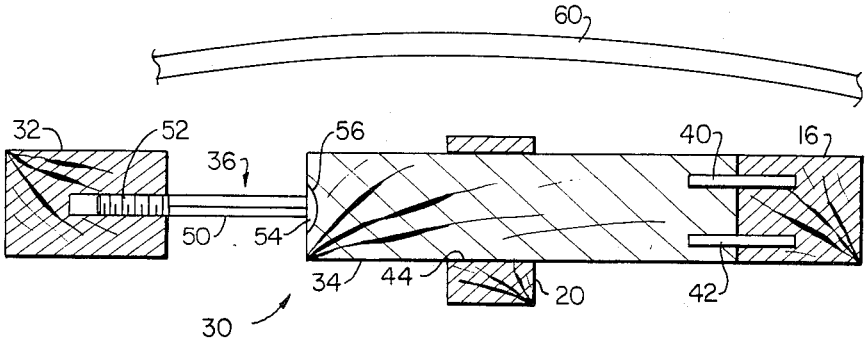
FIG. 3A is a cross-sectional diagram taken along line 3—3 of FIG. 2.

Beam 34, FIG. 3A, is typically made of spruce, is about thirteen inches long and one inch square, and is fastened to support belly rail 16 by maple dowels 40, 42. Beam 34 passes through a guide hole 44 in beam 20. Bolt 36 has a two-inch shank 50 with a square cross section that can be easily gripped by a wrench. The threaded portion 52 is about six inches long and extends fully into fillet 32. The rounded head 54 of bolt 36 is about three quarters of an inch in diameter and nests in a conforming recess 56 in the end of beam 34. The proper tensioning of the soundboard tension adjuster 30 by means of bolt 36 produces the proper curvature, or crown, in soundboard 60, a portion of which is shown in FIG. 3A.

Figure 3B:
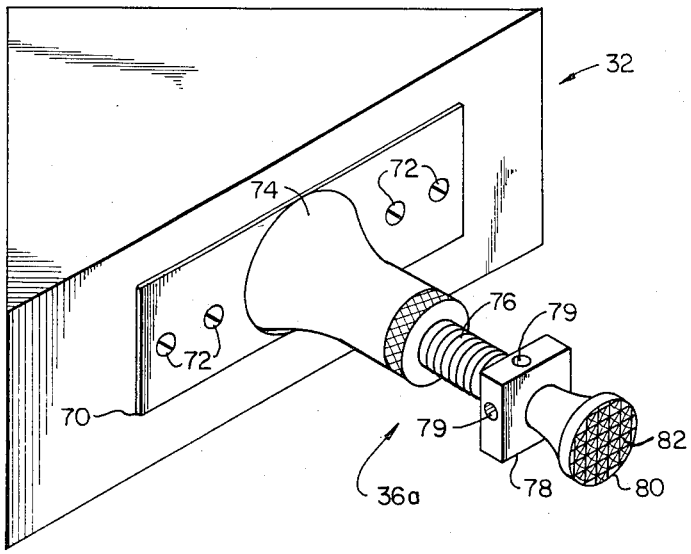
FIG. 3B is an enlarged axonometric view of an alternative tension adjuster.

In preferred constructions bolt 36 is replaced by a small machine shop jack **36*a*, FIG. 3B, on mounting plate 70 fastened to fillet 32 by screws 72. Jack 36*a* includes a base 74 which receives threaded screw shaft 76, at the end of which is a block 78 with holes 79 for receiving a pin or screwdriver shaft to rotate screw shaft 76. Pad 80, swivelly mounted to block 78, has a knurled outer surface 82 for engaging beam 34**.

Figure 5:
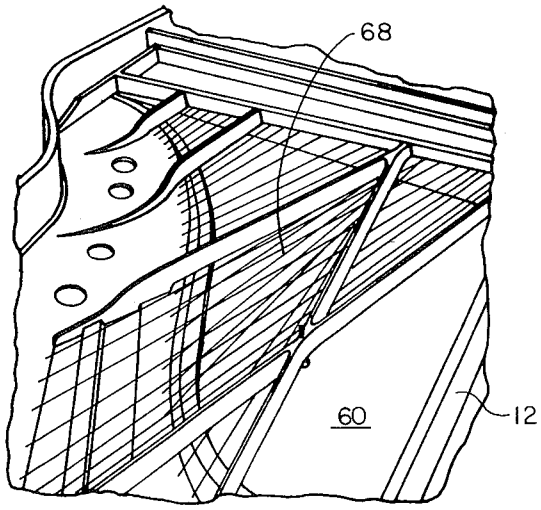
FIG. 5 is a view similar to FIG. 4 with the strings installed.
Figure 4:
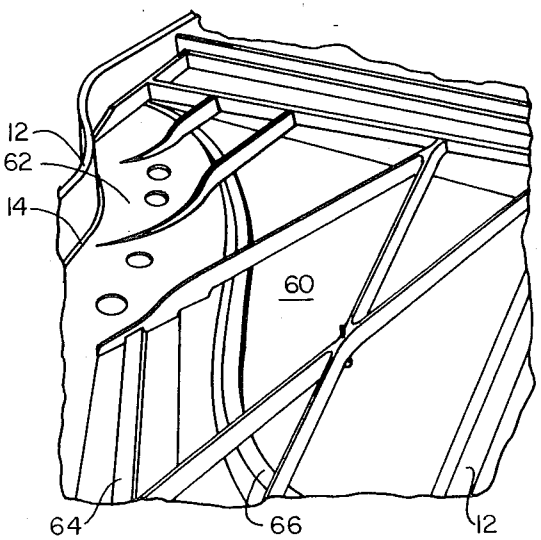
FIG. 4 is an axonometric view similar to that shown in FIG. 1 with the sounding board, cast iron plate and bridge installed.

Soundboard 60, typically a butt end laminated sheet of spruce, is contoured to fit on top of inner rim 14 of the piano below the cast iron plate 62, FIG. 4, and bridges 64 and 66. The completed piano, with strings 68 installed, is shown in FIG. 5. These strings apply a collective tension of over eighteen tons to the soundboard which is borne by the support structure including the soundboard tension adjuster.

Other embodiments will occur to those skilled in the art and are within the following claims:

What is claimed is:

1. A piano tension adjusting system comprising a rim, a belly rail, a soundboard, and a tension adjusting device, said tension adjusting device being interconnected between said rim and said belly rail to adjust the tension on the soundboard and including a beam memeber and adjustment means for selectively increasing the length of the tension adjusting device to increase the tension applied to the soundboard and decreasing the length of the tension adjusting device to decrease the tension applied to the soundboard.

2. The adjuster of claim 1 in which said beam member is fixed with said belly rail and said adjustment means engages said rim.

3. The adjuster of claim 1 in which said adjustment means includes a bolt one end of which engages with said beam member.

4. The adjuster of claim 3 further including an intermediate member between said rim and said bolt.

5. The adjuster of claim 4 in which said intermediate member is a fillet attached to said rim.

6. The adjuster of claim 1 in which said adjustment means includes a jack.

7. The adjuster of claim 1 in which there is an intermediate beam disposed between said rim and belly rail transverse to said beam member and having guide means for receiving said beam member.

* * * * *